US007984813B1

(12) United States Patent
Tapager

(10) Patent No.: US 7,984,813 B1
(45) Date of Patent: Jul. 26, 2011

(54) WINE GLASS AND BOTTLE HOLDER SYSTEM

(76) Inventor: John T. Tapager, Austin, MN (US)

( * ) Notice: Subject to any disclaimer, the term of this patent is extended or adjusted under 35 U.S.C. 154(b) by 620 days.

(21) Appl. No.: 12/027,681

(22) Filed: Feb. 7, 2008

Related U.S. Application Data

(60) Provisional application No. 60/892,487, filed on Mar. 1, 2007.

(51) Int. Cl.
*A47B 73/00* (2006.01)

(52) U.S. Cl. ..... 211/74

(58) Field of Classification Search ..... 211/85.18, 211/181.1, 74, 85.21, 85.23, 71.01, 85.29, 211/41.11, 85.4, 60.1; 248/175, 311.3; 220/743, 220/737, 487, 495, 494; D7/701, 637, 704–708, D7/600.1
See application file for complete search history.

(56) References Cited

U.S. PATENT DOCUMENTS

| | | | | | |
|---|---|---|---|---|---|
| 1,112,558 | A | * | 10/1914 | Red | 248/129 |
| 1,631,725 | A | * | 6/1927 | Halvorsen | 211/85.31 |
| 1,897,905 | A | * | 2/1933 | Johnson | 248/121 |
| 2,456,535 | A | * | 12/1948 | Rundell | 248/302 |
| D152,826 | S | * | 2/1949 | Raysik | D7/704 |
| D165,303 | S | * | 11/1951 | Rogers et al. | D7/706 |
| D166,410 | S | * | 4/1952 | Press | D7/364 |
| D228,858 | S | * | 10/1973 | Wagschal | D7/708 |
| D230,242 | S | * | 2/1974 | Bentley | D7/708 |
| 4,093,076 | A | * | 6/1978 | Newton | 211/74 |
| 4,428,484 | A | | 1/1984 | Rattay et al. | |
| D272,699 | S | * | 2/1984 | Godfrey | D7/701 |
| 4,546,883 | A | | 10/1985 | Youngdale | |
| D282,701 | S | * | 2/1986 | Tomlin | D7/701 |
| 4,836,392 | A | * | 6/1989 | Constantino | 211/133.5 |
| D313,132 | S | * | 12/1990 | Masacek | D6/469 |
| D331,174 | S | * | 11/1992 | Polski | D7/701 |
| 5,180,066 | A | | 1/1993 | McArdie | |
| 5,248,048 | A | | 9/1993 | Dore | |
| D346,095 | S | * | 4/1994 | Gower | D7/701 |
| 5,624,043 | A | | 4/1997 | Baptista | |
| 5,711,436 | A | | 1/1998 | Moeller et al. | |
| D392,163 | S | * | 3/1998 | Jenkinson | D7/704 |
| 5,740,928 | A | * | 4/1998 | Dale et al. | 211/71.01 |
| 5,765,700 | A | * | 6/1998 | Donne | 211/85.31 |
| D397,000 | S | * | 8/1998 | Goodman et al. | D7/637 |
| 5,833,080 | A | * | 11/1998 | Donne | 211/85.31 |
| 5,893,469 | A | * | 4/1999 | Nozawa | 211/71.01 |
| D422,140 | S | * | 4/2000 | Chen | D3/308 |
| 6,283,566 | B1 | * | 9/2001 | Doces | 312/351 |
| 6,599,482 | B1 | * | 7/2003 | Dorin et al. | 422/104 |
| 6,889,945 | B2 | | 5/2005 | McCall | |
| D526,170 | S | * | 8/2006 | Gugni | D7/706 |
| D559,050 | S | * | 1/2008 | Mungal | D7/704 |
| 7,340,859 | B2 | * | 3/2008 | Palsrok | 47/39 |
| D566,480 | S | * | 4/2008 | Lawler | D7/620 |
| 7,467,768 | B1 | * | 12/2008 | Vait | 248/133 |
| D587,076 | S | * | 2/2009 | Grady | D7/704 |
| D618,525 | S | * | 6/2010 | Garnero et al. | D7/706 |

(Continued)

*Primary Examiner* — Jennifer E. Novosad
(74) *Attorney, Agent, or Firm* — Neustel Law Offices

(57) ABSTRACT

A wine bottle holder which includes an upper support structure including an upper opening, a lower support structure including a lower opening, wherein the lower opening and the upper opening are substantially concentric and including at least one support member connecting the upper support structure to the lower support structure, wherein the support member includes an upper end and a lower end. The upper end includes an upper distal portion extending outwardly from the upper support structure and the lower end includes a lower distal portion extending outwardly from the lower support structure.

10 Claims, 7 Drawing Sheets

U.S. PATENT DOCUMENTS

| | | | | |
|---|---|---|---|---|
| 7,793,793 | B1 * | 9/2010 | Sykes | 211/85.2 |
| 2005/0269277 | A1 | 12/2005 | Su | |
| 2006/0037925 | A1 * | 2/2006 | Wood et al. | 211/195 |
| 2006/0261019 | A1 * | 11/2006 | Chao et al. | 211/74 |
| 2008/0173600 | A1 * | 7/2008 | Mungal | 211/71.01 |
| 2009/0020667 | A1 * | 1/2009 | Johnson | 248/186.1 |
| 2009/0258127 | A1 * | 10/2009 | Holtz | 426/412 |

* cited by examiner

WINE GLASS AND BOTTLE HOLDER SYSTEM

CROSS REFERENCE TO RELATED APPLICATIONS

I hereby claim benefit under Title 35, United States Code, Section 119(e) of U.S. provisional patent application Ser. No. 60/892,487 filed Mar. 1, 2007. The 60/892,487 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to merchandise holders and more specifically it relates to a wine glass and bottle holder system for efficiently displaying, holding and transporting a wine bottle and a plurality of wine glasses.

2. Description of the Related Art

Any discussion of the prior art throughout the specification should in no way be considered as an admission that such prior art is widely known or forms part of common general knowledge in the field.

Drinking wine requires a user to transport both a bottle and a plurality of wine glasses to a desired location. It can be difficult to transport the wine bottle along with the wine glasses which requires the user to use both hands. In addition, the user can accidentally drop a wine glass during transportation. Further, the displaying a wine bottle and wine glasses can be difficult wherein both the wine bottle and the wine glasses are displayed together.

Because of the inherent problems with the related art, there is a need for a new and improved wine glass and bottle holder system for efficiently displaying, holding and transporting a wine bottle and a plurality of wine glasses.

BRIEF SUMMARY OF THE INVENTION

The general purpose of the present invention is to provide a wine glass and bottle holder system that has many of the advantages of conventional wine bottle racks mentioned heretofore. The invention generally relates to a wine bottle holder which includes an upper support structure including an upper opening, a lower support structure including a lower opening, wherein the lower opening and the upper opening are substantially concentric and including at least one support member connecting the upper support structure to the lower support structure, wherein the support member includes an upper end and a lower end. The upper end includes an upper distal portion extending outwardly from the upper support structure and the lower end includes a lower distal portion extending outwardly from the lower support structure.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a wine glass and bottle holder system for holding at least one wine bottle and a plurality of wine glasses.

Another object is to provide a wine glass and bottle holder system that securely retains a wine bottle and a plurality of wine glasses.

A further object is to provide a wine glass and bottle holder system that is capable of receiving various sizes and shapes of wine bottles.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
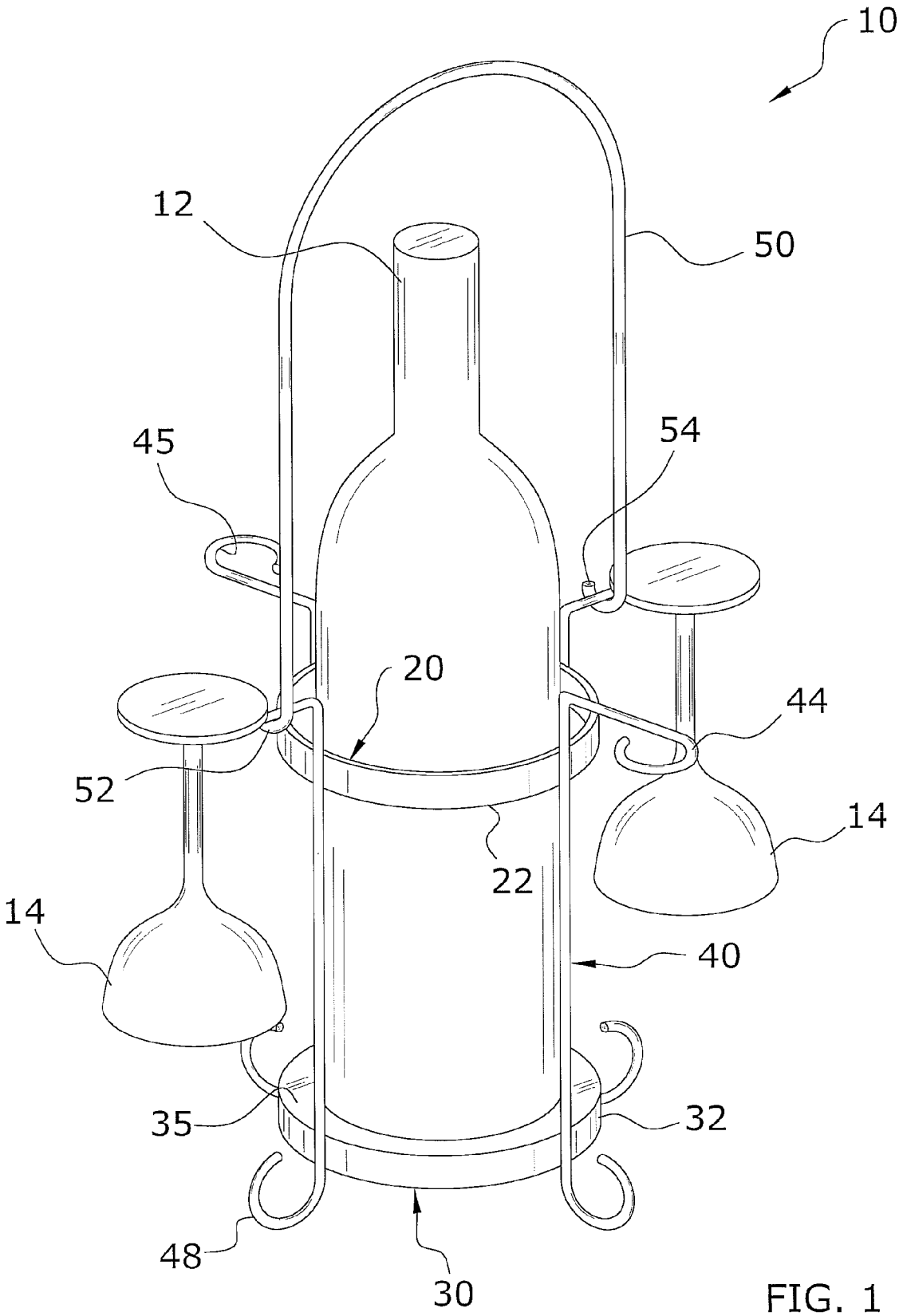
FIG. 1 is an upper perspective view of the present invention in use while holding a wine bottle and a plurality of wine glasses.

Turning now descriptively to the drawings, in which similar reference characters denote similar elements throughout the several views, FIGS. 1 through 7 illustrate a wine glass and bottle holder system 10, which comprises an upper support structure 20 including an upper opening 23, 25, a lower support structure 30 including a lower opening 36, wherein the lower opening 36 and the upper opening 23, 25 are substantially concentric and including at least one support member 40 connecting the upper support structure 20 to the lower support structure 30, wherein the support member 40 includes an upper end and a lower end. The upper end includes an upper distal portion 44 extending outwardly from the upper support structure 20 and the lower end includes a lower distal portion 48 extending outwardly from the lower support structure 30.

The distal portions 44, 48 are preferably comprised of substantially circular configurations, wherein at least one of the distal portions 44, 48 preferably receives the stem of a wine glass 14, wherein the wine glass 14 is suspended upside down from the distal portion 44, 48. The opposing distal portion 44, 48 may serves as a base for the present invention or to suspend another wine glass 14. In the below description of the present invention a wine glass 14 is described as being supported by the present invention; however it is appreciated that the distal portions 44, 48 may be utilized to suspend or support various other merchandise rather than a wine glass 14.

The upper opening 23, 25 and the lower opening 36 of the upper support structure 20 and the lower support structure 30 respectively preferably receive a wine bottle 12 to accommodate the wine glasses 14. The wine bottle 12 may be positioned within the upper opening 23, 25 and the lower opening 36 either right side up or upside down as illustrated in FIGS. 1 and 2.

Figure 5:
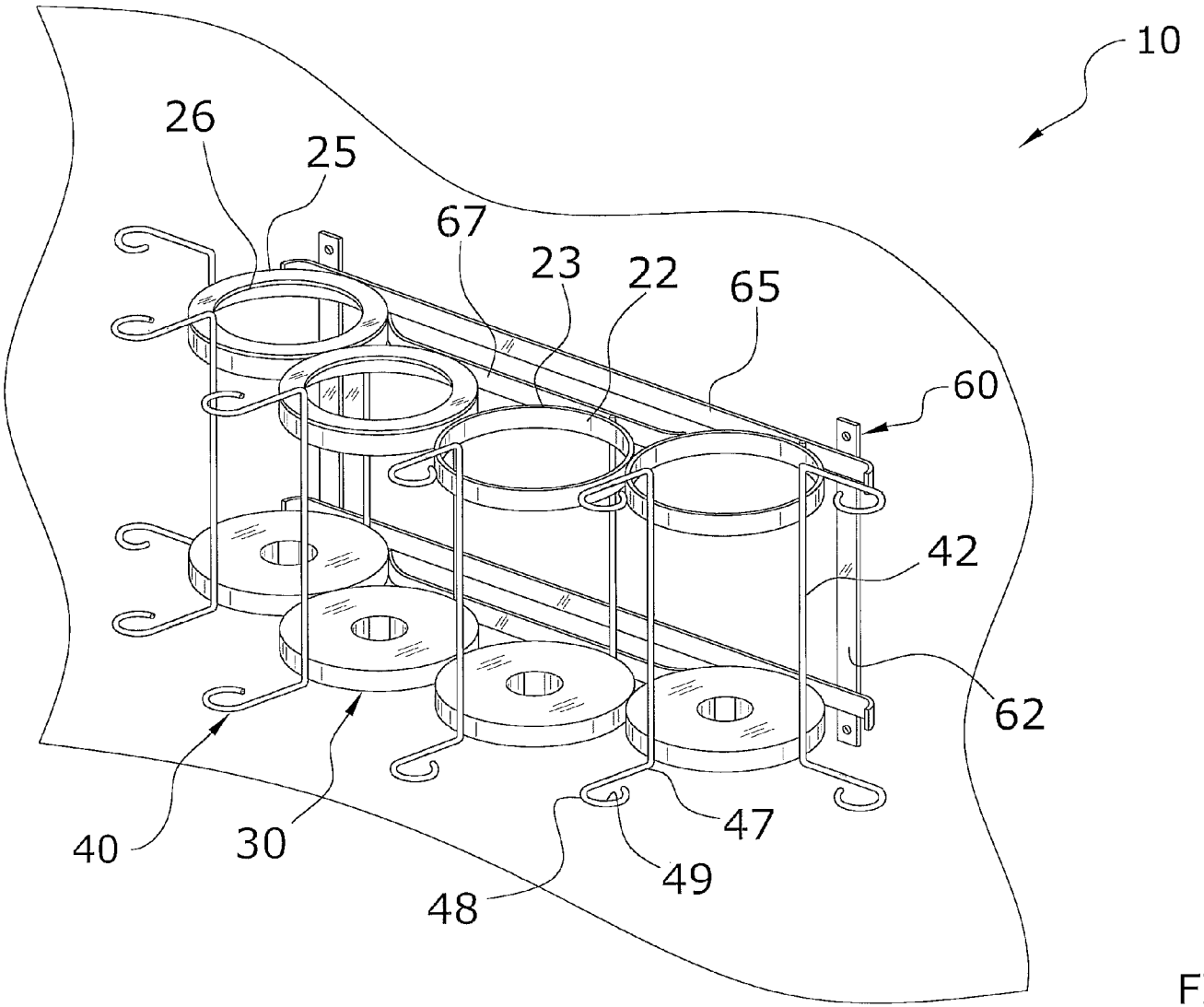
FIG. 5 is an upper perspective view of the second alternative configuration of the present invention.
Figure 6:
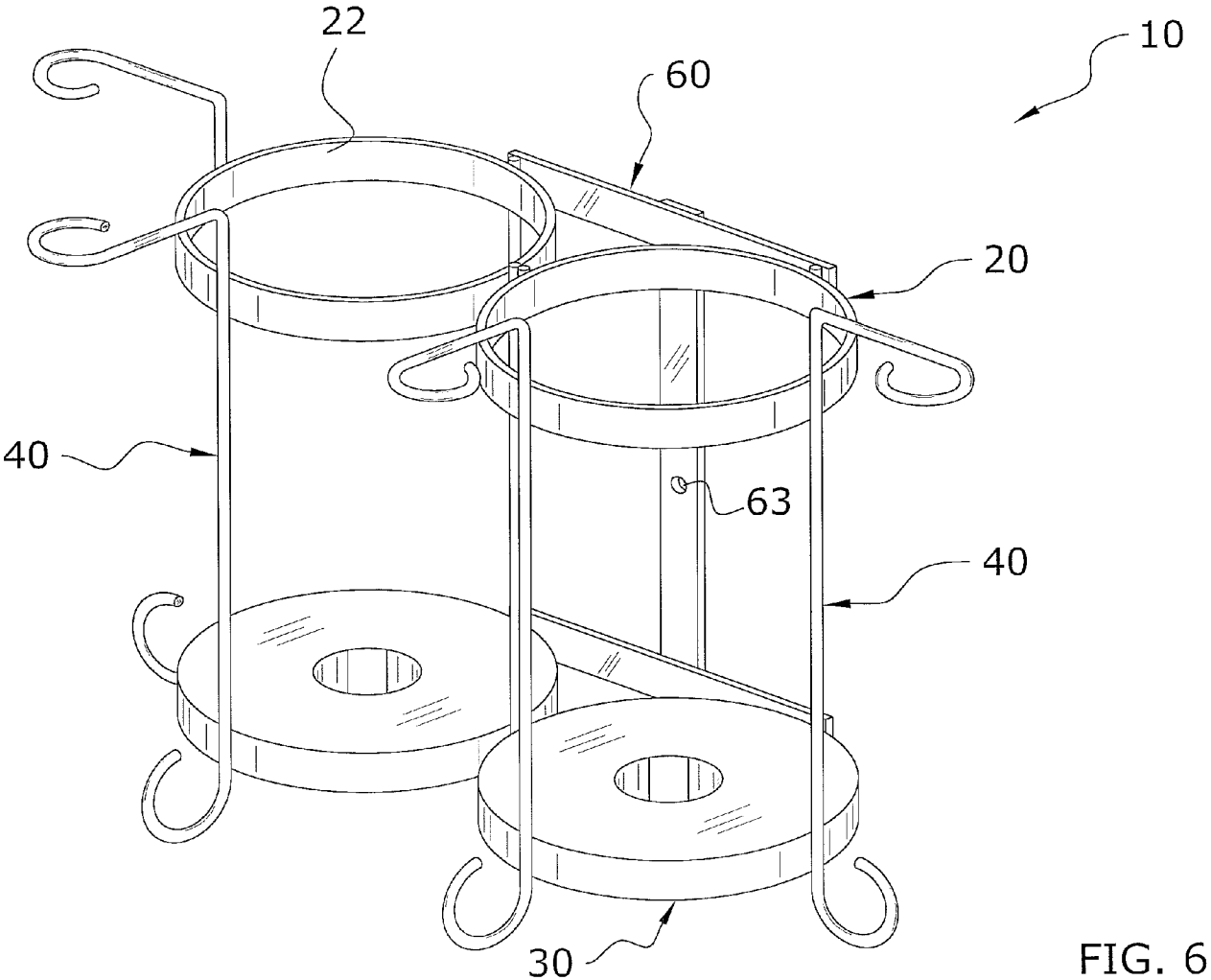
FIG. 6 is an upper perspective view of a third alternative configuration of the present invention.

In the below description of the present invention a wine bottle 12 is described as being supported by the present invention; however it is appreciated that the upper opening 23, 25 and the lower opening 36 may collectively receive various other merchandise rather than a wine bottle 12, such as but not limited to flower vases 16 and various other types of bottles 12. It is also appreciated that the present invention may be constructed in various configurations, wherein various displayed configurations may be combined and wherein additional configurations may be utilized to hold more or less bottles 12 and/or glasses 14. It is further appreciated that the present invention may be constructed in various configurations, wherein the present invention may be comprised of a free-standing as shown in FIG. 1, a wall mounted configuration as shown in FIG. 5 or a combination of a free-standing configuration and a wall mounted configuration as shown in FIG. 6.

B. Upper Support Structure

Figure 2:
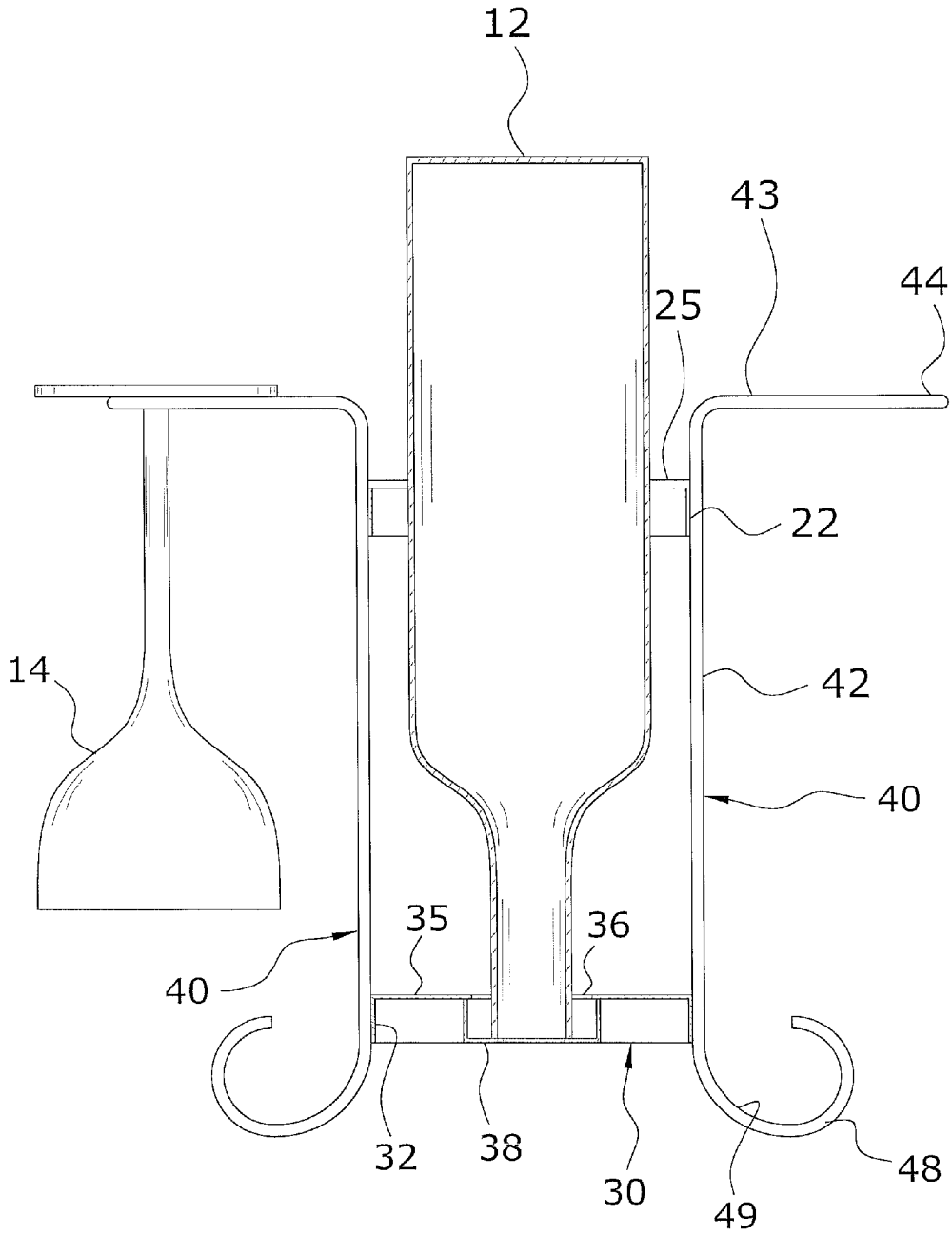
FIG. 2 is a cross-sectional view of the present invention in use while holding a wine bottle and a plurality of wine glasses.
Figure 7:
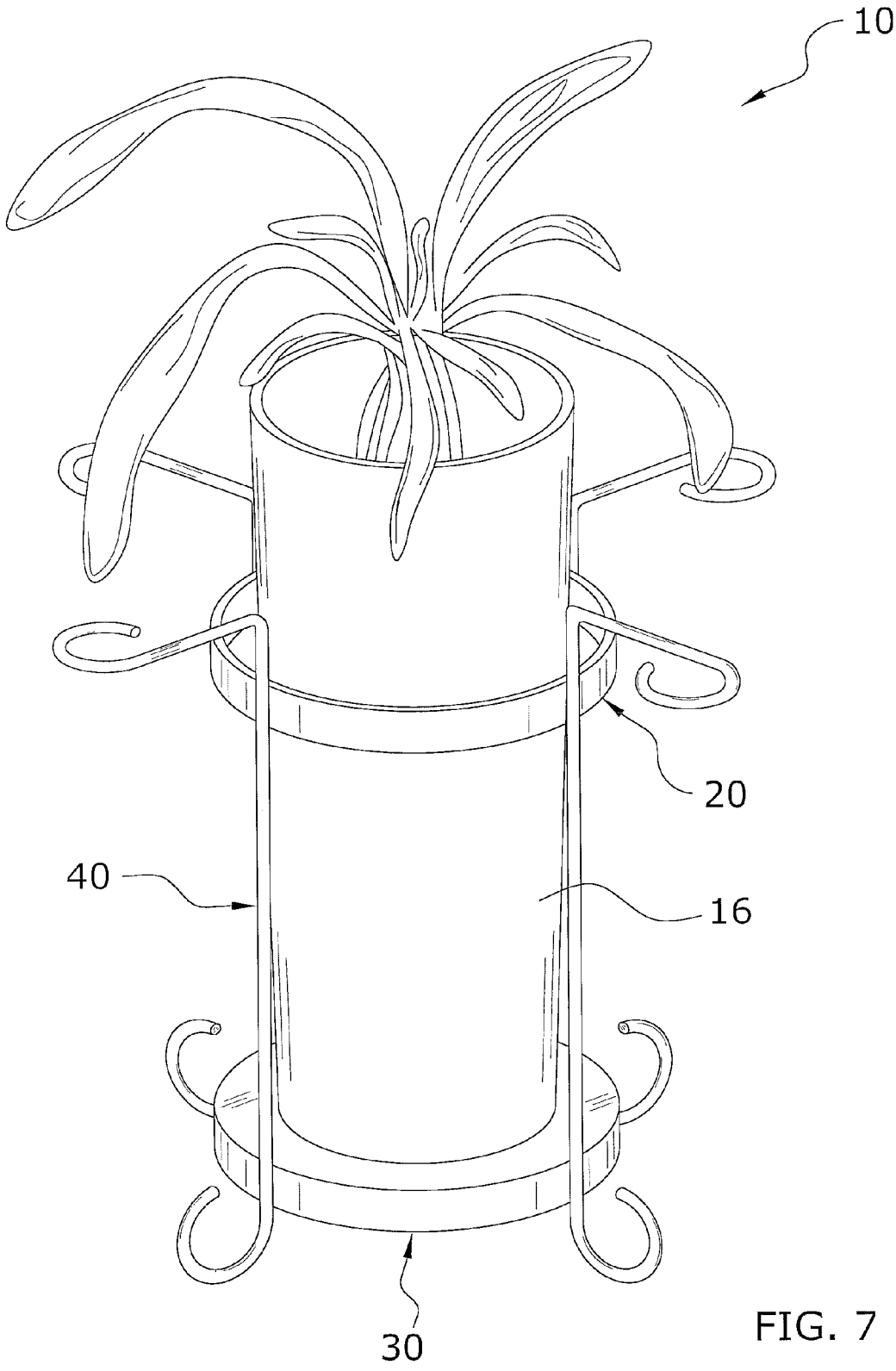
FIG. 7 is an upper perspective view of the present invention in use while holding a flower vase.

The upper support structure 20 may be comprised of various shapes, all which adequately receive a bottle 12 and/or a vase 16 as illustrated in FIGS. 1, 2 and 7. In some configurations of the upper support structure 20 it is appreciated that the upper support structure 20 may receive two or even a plurality of bottles 12. The upper support structure 20 may be comprised of various materials, such as but not limited to metal, wood or plastic. The upper support structure 20 is also preferably positioned substantially above the lower support structure 30 to efficiently stabilize the bottle 12. In the free standing configuration of the present invention the upper support structure 20 is further substantially parallel with the supporting surface (i.e. table top, shelf, etc.) and the lower support structure 30 as illustrated in FIGS. 1, 2 and 7.

Figure 3:
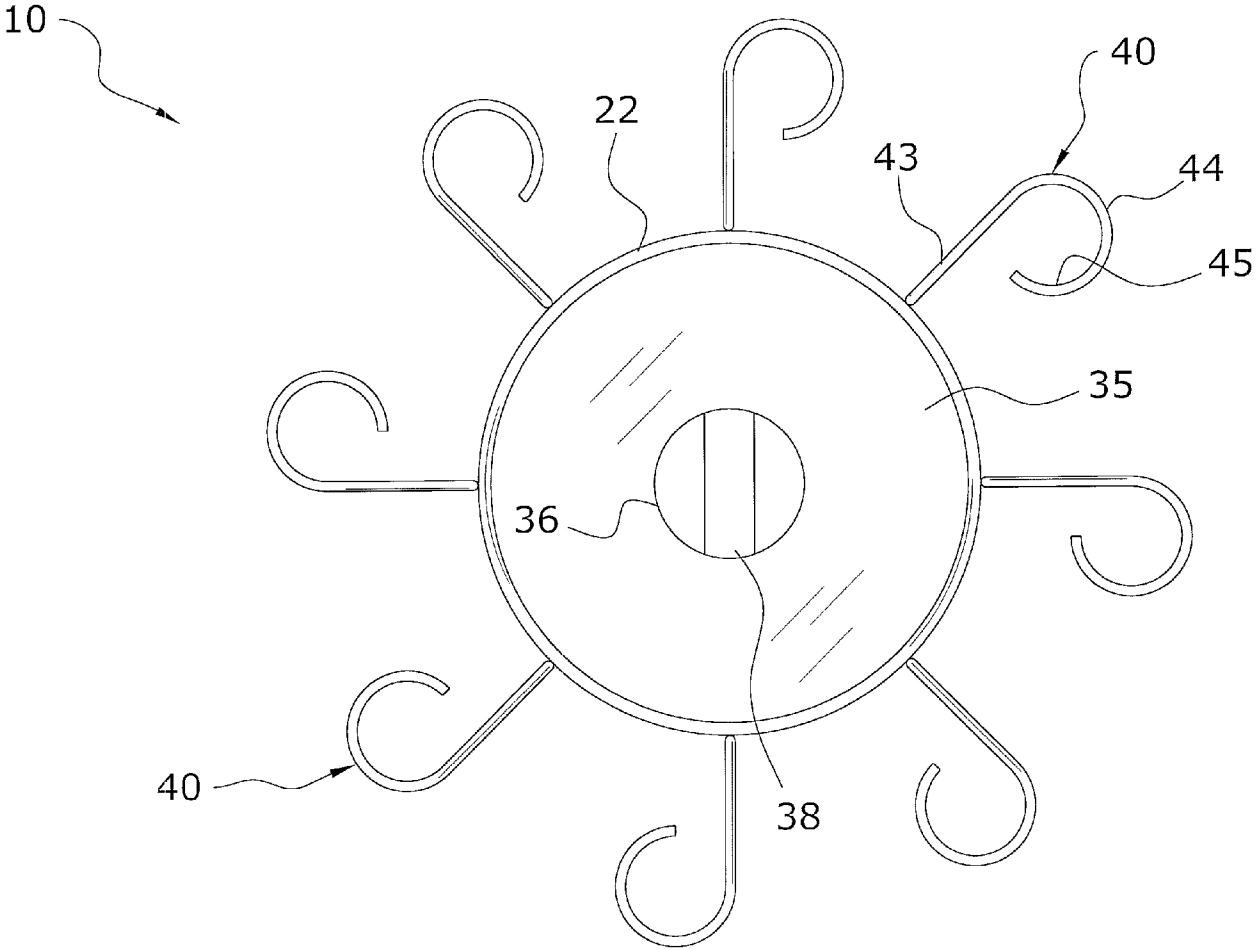
FIG. 3 is a top view of a first alternative configuration of the present invention.

The upper support structure 20 includes an upper ring 22. The upper ring 22 is preferably comprised of a substantially circular shaped configuration. It is appreciated that the upper support structure 20 may include a plurality of upper rings 22 when securing more than one bottle 12 within the present invention. The upper rings 22 include a first upper opening 23. The first upper opening 23 is preferably substantially similar in diameter as the diameter of the bottle 12. The upper ring 22 is further preferably concentric with a majority of the support members 40 as illustrated in FIGS. 1 through 3.

The upper support structure 20 may also include a spacer member 25. The spacer member 25 is preferably removably positioned upon an upper end of the upper ring 22 as illustrated in FIGS. 1, 2 and 5. The spacer member 25 is further preferably concentrically positioned upon the upper ring 22. The spacer member 25 includes a second upper opening 26, wherein the second upper opening 26 is concentric with the first upper opening 23. The second upper opening 26 is preferably comprised of a lesser diameter than the first upper opening 23.

The spacer member 25 is preferably utilized when the diameter of the bottle 12 is substantially less than the diameter of the first upper opening 23. The spacer member 25 serves to further stabilize the bottle 12 within the upper support structure 20 as illustrated in FIGS. 1 and 2. The spacer member 25 and the upper ring 22 are preferably comprised of separate structures; however it is appreciated that the spacer member 25 and the upper ring 22 may be comprised of an integrally formed structure.

C. Lower Support Structure

The lower support structure 30 may be comprised of various shapes, all which adequately receive a bottle 12 and/or a vase 16 as illustrated in FIGS. 1, 2 and 7. In some configurations of the lower support structure 30 it is appreciated that the lower support structure 30 may receive two or even a plurality of bottles 12. The lower support structure 30 may be comprised of various materials, such as but not limited to metal, wood or plastic. The lower support structure 30 is further preferably substantially concentric with the upper support structure 20. The outer diameter of the lower support structure 30 is also preferably substantially similar to the outer diameter of the upper support structure 20.

The lower support structure 30 is also preferably positioned substantially below the upper support structure 20 to efficiently stabilize the bottle 12. In the free standing configuration of the present invention, the lower support structure 30 is also preferably positioned substantially close to the supporting surface. In the free standing configuration of the present invention the lower support structure 30 is further substantially parallel with the supporting surface and the upper support structure 20 as illustrated in FIGS. 1, 2 and 7.

The lower support structure 30 includes a lower ring 32. The lower ring 32 serves to stabilize the lower end of the present invention. The lower ring 32 is also preferably comprised of a substantially circular shaped configuration as illustrated in FIGS. 3, 5 and 6. The lower support structure 30 also includes the lower support member 35. The lower support member 35 is preferably attached to the lower ring 32. The lower support member 35 is further preferably concentrically positioned upon the lower ring 32. The lower support member 35 includes a lower opening 36, wherein the lower opening 36 is concentric with the first upper opening 23 and the second upper opening 26 as illustrated in FIG. 3. The lower opening 36 is preferably comprised of a lesser diameter than the lower ring 32.

The lower support member 35 serves to support the base of the bottle 12 when the bottle 12 is oriented upwards. The lower opening 36 of the lower support subsequently serves to receive the neck or cap of the bottle 12 when the bottle 12 is oriented upside down as illustrated in FIG. 2.

Figure 4:
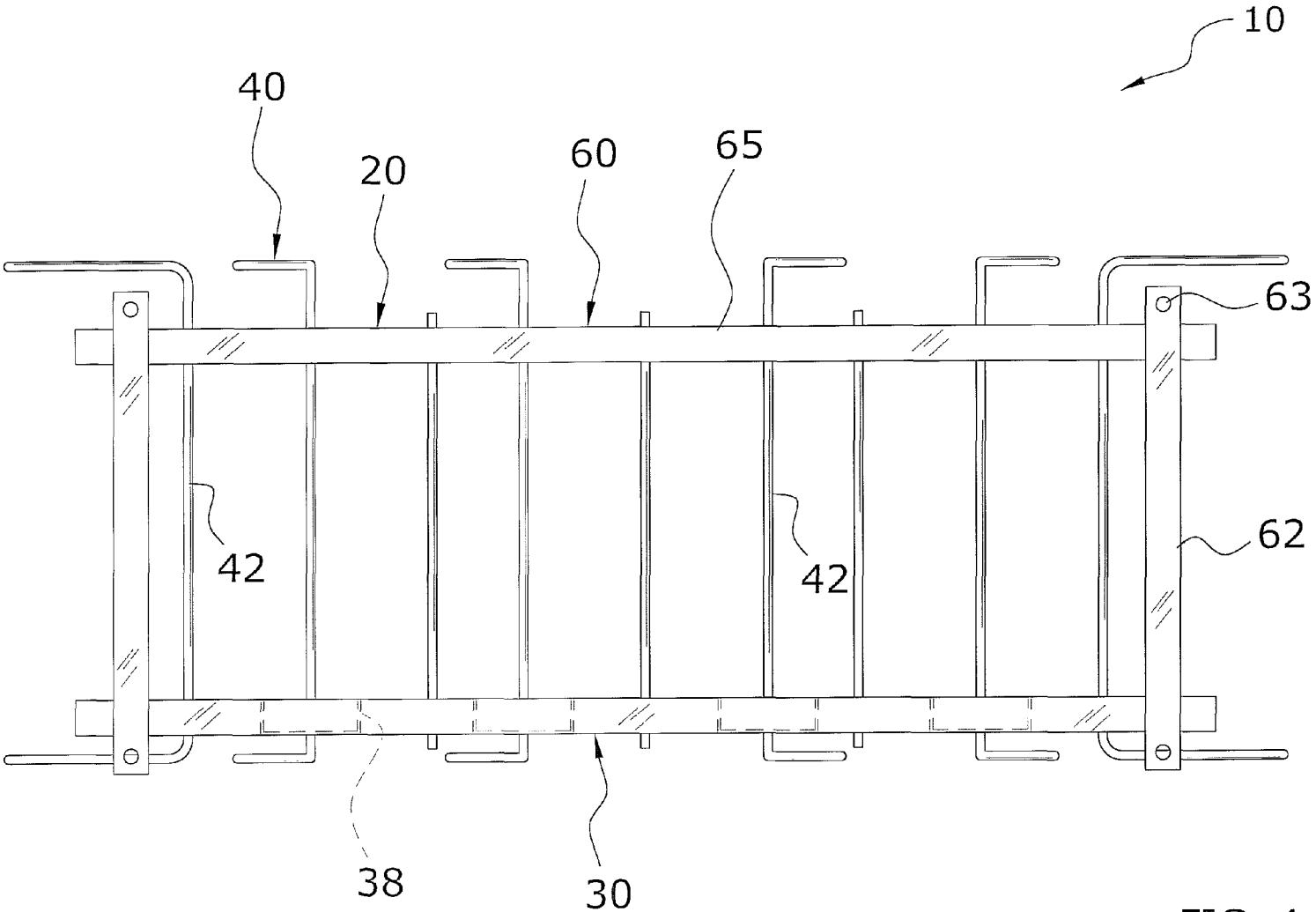
FIG. 4 is a rear view of a second alternative configuration of the present invention.

The lower support structure 30 also includes a bracket 38 as illustrated in FIGS. 2 and 4. The bracket 38 is attached to a lower end of the lower support structure 30 and is preferably concentric with the lower opening 36. The bracket 38 is preferably comprised of a U-shaped configuration. The bracket 38 is further positioned between the lower opening 36 and the supporting surface, wherein the bracket 38 supports the cap of the bottle 12 when the neck or cap extends through the lower opening 36.

D. Support Member

The present invention preferably includes a plurality of support members 40 extending between the upper support structure 20 and the lower support structure 30 as illustrated in FIGS. 1 and 4. The support members 40 are also preferably radially spaced around the outer edges of the upper support structure 20 and the lower support structure 30; however it is appreciated that the support members 40 may be positioned about the upper support structure 20 and the lower support structure 30 in various configurations. It is appreciated that in the wall mount configuration of the present invention the support members 40 do not extend toward the rear of the present invention adjacent the wall as illustrated in FIGS. 5 and 6.

The support members 40 serve to both suspend the wine glasses 14 and to support the present invention upon the supporting surface as shown in FIGS. 1 and 2. The support members 40 may also be utilized to extend decorations from. In the wall supported configuration of the present invention the support members 40 may suspend wine glasses 14 from both an upper end and a lower end of the support members 40. The support members 40 are also preferably substantially perpendicular to the upper support structure 20 and the lower support structure 30.

The support members 40 are preferably comprised of an elongated and cylindrical configuration as illustrated in FIG. 1. The support members 40 are also preferably comprised of a slender configuration. The support members 40 and the present invention are further preferably comprised of an aesthetically pleasing configuration.

The support members 40 may be comprised of various materials, such as but not limited to metal, plastic or wood. The support members 40 are also preferably comprised of a material that is durable and strong, wherein the support members 40 may efficiently support the upper support structure 20 and also stabilize the present invention upon the supporting surface.

The support members 40 include a connecting portion 42. The connecting portion 42 preferably extends from the upper support structure 20 to the lower support structure 30 as shown in FIGS. 1 and 2. The connecting portion 42 is preferably comprised of a substantially straight structure. The support members 40 also preferably include an upper extending portion 43. The upper extending portion 43 extends from the connecting portion 42 adjacent the upper support structure 20 is preferably an upper extending portion 43. The upper extending portion 43 preferably extends perpendicularly outwardly from the connecting portion 42 and the upper support structure 20.

The upper extending portion 43 is preferably comprised of a length substantially similar or slightly greater than the radius of the wine glass 14 to prevent the wine glass 14 from engaging the bottle 12 when suspended from the support members 40 as illustrated in FIG. 2. The upper extending portion 43 also preferably includes an upper distal portion 44. The upper distal portion 44 extends from the upper extending portion 43 and forms a substantially circular configuration. The stem of the wine glass 14 is preferably positioned within a first outer opening 45 formed by the upper distal portion 44 as illustrated in FIGS. 1 and 2. The upper distal portion 44 and the first outer opening 45 are preferably substantially parallel to the upper support structure 20 and the lower support structure 30.

In the wall attachment configuration of the present invention, a lower extending portion 47 may also extend from the connecting portion 42 of the support member 40 adjacent the lower support structure 30. The lower extending portion 47 preferably extends perpendicularly outwardly from the connecting portion 42 and the lower support structure 30 as illustrated in FIG. 5. The lower extending portion 47 is preferably comprised of a length substantially similar or slightly greater than the radius of the wine glass 14.

The lower extending portion 47 also preferably includes a lower distal portion 48. The lower distal portion 48 extends from the lower extending portion 47 and forms a substantially circular configuration as illustrated in FIG. 5. The stem of the wine glass 14 is preferably positioned within a second outer opening 49 formed by the lower distal portion 48. The lower distal portion 48 and the lower outer opening are preferably substantially parallel to the upper support structure 20 and the lower support structure 30.

In the free standing configuration of the present invention, the lower extending portion 47 may be omitted and the lower distal portion 48 preferably extends directly from the connecting portion 42 as illustrated in FIGS. 1 and 2. The lower distal portion 48 subsequently forms the base for the present invention. The lower distal portion 48 and the second outer opening 49 are further preferably perpendicular to the upper support structure 20 and the lower support structure 30 as illustrated in FIGS. 1 and 2. It is appreciated that the support members 40 may be comprised of various configurations all which adequately suspend or hold a wine glass 14.

E. Handle

The present invention may also include a handle 50 to allow for easier mobility of the present invention. The handle 50 may be comprised of various materials, such as but not limited to plastic, metal or wood. The handle 50 is further preferably comprised of a similar material as the support members 40. The handle 50 preferably removably attaches to the upper extending portions 43 of the support members 40 as shown in FIG. 1.

The handle 50 is preferably comprised of an arc-shaped configuration as shown in FIG. 1. The handle 50 also includes a first end 52 and a second end 54, wherein the second end 54 is opposite the first end 52. The first end 52 and the second end 54 are preferably comprised of a U-shaped configuration. The U-shape of the first end 52 of the handle 50 preferably extends in an opposing direction as the U-shape of the second end 54 of the handle 50 to provide a more secure attachment between the handle 50 and the support member 40.

F. Attachment Structure

The attachment structure 60 is utilized when the attaching the present invention to a wall in the wall mount configuration of the present invention. The attachment structure 60 is preferably comprised of a rigid structure. The attachment structure 60 also preferably extends outwardly from the rear of the present invention as illustrated in FIGS. 4 through 6. The attachment structure 60 may be comprised of various materials, such as but not limited to plastic, metal or wood.

The attachment structure 60 includes an attachment member 60 and a connecting member 67. The connecting member 67 extends outwardly from the rear of the upper support structure 20 and the lower support structure 30. Attached to the connecting member 67 is the attachment member 60. The attachment member 60 is preferably positioned adjacent the wall when attaching the present invention to the wall. The attachment member 60 preferably includes at least one aperture 63 extending through the attachment member 60. The aperture 63 preferably receives a fastener, wherein the fastener extends within the wall and attaches the attachment member 60 and thus present invention to the wall.

It is appreciated that for various embodiments of the present invention the attachment structure 60 may include a cross member 65 as illustrated in FIGS. 4 through 6. The cross member 65 serves to further add support between the attachment structure 60, the upper support structure 20 and the lower support structure 30.

G. In Use

In use, with the free standing configuration of the present invention, the present invention is positioned upon a supporting surface. A wine bottle 12 is then positioned within the first upper opening 23 and against the lower support member 35, wherein the wine bottle 12 is oriented upwards as illustrated in FIG. 1. The wine bottle 12 may also be oriented upside down, wherein the wine bottle 12 is again extended through the first upper opening 23 and the cap and neck are extended through the lower opening 36, wherein the cap is subsequently positioned upon the bracket 38 as illustrated in FIG. 2.

The spacer member 25 may also be utilized if the wine bottle 12 is able to substantially wobble within the first upper opening 23. To utilize the spacer member 25 the wine bottle 12 is temporarily removed from the present invention and the spacer member 25 is positioned upon the upper support structure 20. The bottle 12 may now be replaced within the present invention through the second upper opening 26 of the spacer member 25 as illustrated in FIGS. 1 and 2.

The wine glasses 14 may now be positioned within the upper distal portions 44 of the support member 40 by extending the neck of the wine glasses 14 within the first outer openings 45 as illustrated in FIGS. 1 and 2. The base of the wine glass 14 is rested upon the upper distal portion 44, wherein the wine glass 14 is suspended upside down from the upper distal portion 44. Additional wine glasses 14 may also be positioned within additional upper distal portions 44.

During use with the wall mount configuration of the present invention, the attachment structure 60 is positioned against the desired wall, wherein the upper support structure 20 and the lower support structure 30 are ensured to be perpendicular with the wall and oriented parallel with the below surface (i.e. floor, table top, etc.). At least one fastener is then preferably extended through the aperture 63 of the support structure and extended within the wall. The wine glasses 14 and bottle 12 may now be positioned within the present invention in a similar manner as with the free standing configuration of the present invention.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A wine glass and bottle holder system, comprising:

a wine bottle;

a plurality of wine glasses;

a lower support structure having a lower ring and a lower support member extending inwardly from said lower ring;

a lower opening centrally extending within said lower support member, wherein said lower opening has a size slightly larger than a neck of said wine bottle and receives said neck of said wine bottle;

a lower bracket attached to said lower support member and positioned beneath said lower opening to support a distal end of said neck of said wine bottle;

a plurality of support members attached to said lower ring and extending upwardly, wherein said plurality of wine glasses are removably supported upon upper portions of said plurality of support members; and an upper support structure attached to an upper portion of said plurality of support members, wherein said upper support structure is comprised of an upper ring defining an upper opening, wherein said upper opening has a size slightly larger than a base of said wine bottle;

wherein said wine bottle is positioned in an inverted manner within said lower support structure and said upper support structure with said neck of said wine bottle positioned within said lower opening along with said distal end of said neck in supported engagement with said lower bracket.

2. The wine glass and bottle holder system of claim 1, wherein said plurality of support members each include an upper extending portion that extends outwardly from said upper support structure in a substantially horizontal manner and wherein said upper extending portion defines a receiver opening for receiving said wine glasses.

3. The wine glass and bottle holder system of claim 2, wherein said upper extending portion is comprised of a hook structure having a receiver opening that receives said wine glass.

4. The wine glass and bottle holder system of claim 2, wherein said upper extending portion is comprised of a C-shaped structure.

5. The wine glass and bottle holder system of claim 1, wherein said plurality of support members are comprised of eight support members.

6. The wine glass and bottle holder system of claim 1, wherein said plurality of support members each include a lower curved base to support said lower support structure above a surface.

7. The wine glass and bottle holder system of claim 1, including at least one attachment member attached to said lower support structure and said upper support structure, wherein said at least one attachment member is comprised of a flat bar and includes at least one attachment aperture for receiving a fastener to secure to a wall.

8. The wine glass and bottle holder system of claim 1, including a handle pivotally attached to a pair of said plurality of support members on opposite sides of said upper support structure.

9. The wine glass and bottle holder system of claim 1, wherein said handle is comprised of a U-shaped structure.

10. A wine glass and bottle holder system, comprising:

a wine bottle;

a plurality of wine glasses;

a lower support structure having a lower ring and a lower support member extending inwardly from said lower ring;

a lower opening centrally extending within said lower support member, wherein said lower opening has a size slightly larger than a neck of said wine bottle and receives said neck of said wine bottle;

a lower bracket attached to said lower support member and positioned beneath said lower opening to support a distal end of said neck of said wine bottle;

a plurality of support members attached to said lower ring and extending upwardly, wherein said plurality of wine glasses are removably supported upon upper portions of said plurality of support members; and an upper support structure attached to an upper portion of said plurality of support members, wherein said upper support structure is comprised of an upper ring defining an upper opening, wherein said upper opening has a size slightly larger than a base of said wine bottle;

wherein said wine bottle is positioned in an inverted manner within said lower support structure and said upper support structure with said neck of said wine bottle positioned within said lower opening along with said distal end of said neck in supported engagement with said lower bracket;

wherein said plurality of support members each include an upper extending portion that extends outwardly from said upper support structure in a substantially horizontal manner and wherein said upper extending portion defines a receiver opening for receiving said wine glasses;

wherein said upper extending portion is comprised of a hook structure having a C-shaped structure with a receiver opening that receives said wine glass;

at least one attachment member attached to said lower support structure and said upper support structure, wherein said at least one attachment member is comprised of a flat bar and includes at least one attachment aperture for receiving a fastener to secure to a wall;

a handle pivotally attached to a pair of said plurality of support members on opposite sides of said upper support structure;

wherein said handle is comprised of a U-shaped structure.

* * * * *